United States Patent [19]

Yoshimura et al.

[11] Patent Number: 5,009,705

[45] Date of Patent: Apr. 23, 1991

[54] MICRODRILL BIT

[75] Inventors: Hironori Yoshimura; Inada Shyogo, both of Tokyo, Japan

[73] Assignee: Mitsubishi Metal Corporation, Tokyo, Japan

[21] Appl. No.: 458,099

[22] Filed: Dec. 28, 1989

[51] Int. Cl.[5] ..... C22C 29/08

[52] U.S. Cl. ..... 75/240; 419/18; 428/552; 428/457; 428/220; 51/307; 407/119

[58] Field of Search ..... 501/87; 75/240; 419/18; 428/552, 457, 220; 51/307; 407/119

[56] References Cited

U.S. PATENT DOCUMENTS

| | | | |
|---|---|---|---|
| 4,203,262 | 5/1980 | Dunnington et al. | 51/204 |
| 4,276,096 | 6/1981 | Kolaska et al. | 419/18 X |
| 4,277,283 | 7/1981 | Tobioka et al. | 419/18 X |
| 4,639,352 | 1/1987 | Kodama et al. | 75/240 X |
| 4,753,678 | 6/1988 | Maruyama et al. | 75/240 X |
| 4,923,512 | 5/1990 | Timm et al. | 75/240 X |
| 4,959,929 | 10/1990 | Burnard et al. | 51/307 |

*Primary Examiner*—Stephen J. Lechert, Jr.
*Assistant Examiner*—Leon Nigohosian, Jr.
*Attorney, Agent, or Firm*—Scully, Scott, Murphy & Presser

[57] ABSTRACT

A microdrill bit is made of a tungsten carbide based cemented carbide which contains a binder phase of 6% by weight to 14% by weight of a cobalt alloy and a hard dispersed phase of balance tungsten carbide. The cobalt alloy contains cobalt, chromium, vanadium and tungsten and has weight ratios so as to satisfy the relationships of $0.04 \leqq (c+d)/(a+b+c+d) \leqq 0.10$ and $0.50 \leqq c/(c+d) \leqq 0.95$, where a, b, c and d denote weight ratios of tungsten, cobalt, chromium and vanadium, respectively. The drill bit is formed so as to have a Rockwell A scale hardness of 92.0 to 94.0.

3 Claims, No Drawings

MICRODRILL BIT

BACKGROUND OF THE INVENTION

1. Field of the Invention

The present invention relates to a microdrill bit of tungsten carbide based cemented carbide which has a high wear resistance and is less susceptible to fracturing.

2. Prior Art

Prior art microdrill bits have been made of a tungsten carbide (WC) based cemented carbide which contains about 1.0% by weight of tantalum carbide (TaC) for preventing grain growth of tungsten carbide (WC) in a hard dispersed phase and about 6% by weight of a cobalt alloy comprised of a solid solution of cobalt (Co) with tungsten.

The aforesaid prior art microdrill bits have been susceptible to fracturing. Therefore, cobalt content in the cemented carbide may be increased to enhance the fracture resistance characteristics. However, a simple increase in the cobalt content results in an undue lowering of the wear resistance of the microdrill bits. Thus, the development of a new cemented carbide for microdrill bits, which exhibits not only a great fracture resistance but also a high wear resistance, has long been desired.

SUMMARY OF THE INVENTION

It is therefore the object of the present invention to provide a tungsten carbide based cemented carbide microdrill bit which is not only less susceptible to fracturing but also exhibits a high wear resistance.

According to the present invention, there is provided a microdrill bit manufactured of a WC-based cemented carbide containing a binder phase of 6% by weight to 14% by weight of a cobalt alloy and a hard dispersed phase of balance tungsten carbide. The cobalt alloy is comprised of cobalt, chromium, vanadium and tungsten and has such weight ratios as to satisfy the relationships of $0.04 \leqq (c+d)/(a+b+c+d) \leqq 0.10$ and $0.50 \leqq c/(c+d) < 0.95$, where a, b, c and d denote weight ratios of tungsten, cobalt, chromium and vanadium, respectively. In addition, the drill bit of the present invention is formed so as to have a Rockwell A scale hardness ($H_RA$) ranging from 92.0 to 94.0.

DETAILED DESCRIPTION OF THE INVENTION

After an extensive study of the improvement of the prior art microdrill bits, the inventors have found that the grain growth of tungsten carbide can be prevented more efficiently by the addition of an appropriate amount of vanadium (V) and chromium (Cr) than by addition of tantalum carbide, and that a prescribed amount of tungsten should be included in the cobalt alloy in order to obtain the desired properties. Thus, the inventors have developed a WC-based cemented carbide to be used for manufacturing a microdrill bit of the invention. The cemented carbide contains a binder phase of 6% by weight to 14% by weight of a cobalt alloy and a hard dispersed phase of balance tungsten carbide. The cobalt alloy is comprised of cobalt, chromium, vanadium and tungsten and has such weight ratios as to satisfy the relationships of $0.04 \leqq (c+d)/(a+b+c+d) \leqq 0.10$ and $0.50 \leqq c/(c+d) \leqq 0.95$, where a, b, c and d denote weight ratios of tungsten, cobalt, chromium and vanadium, respectively. A microdrill bit in accordance with the present invention is manufactured of the aforesaid cemented carbide and has a Rockwell A scale hardness ranging from 92.0 to 94.0.

In the foregoing, if the cobalt alloy content is less than 6% by weight, the resulting microdrill bit becomes susceptible to fracturing. On the other hand, if it exceeds 14% by weight, the microdrill bit will tend to bend and fracture. With this construction, the Rockwell A scale hardness of the microdrill bit is increased so as to be within the aforesaid range.

Furthermore, the amounts of vanadium and chromium in the cobalt alloy are determined so that they have weight ratios satisfying the relationship of $0.04 \leqq (c+d)/(a+b+c+d) \leqq 0.10$. If the ratio defined by $(c+d)/(a+b+c+d)$ is less than 0.04, the grain growth of tungsten carbide in the hard dispersed phase cannot be prevented effectively, and the Rockwell scale A hardness is limited so as to be less than 92.0, so that the wear resistance of the microdrill bit is unduly lowered. On the other hand, if the ratio is above 0.10, the microdrill bit is susceptible to fracturing.

Vanadium and chromium are added so as to form a solid solution with the cobalt alloy. With this procedure, the amount of tungsten which forms a solid solution with the cobalt alloy is decreased, and hence the toughness of the cobalt alloy is prevented from decreasing, and the fracture resistance of the microdrill bit can be improved substantially. The vanadium and chromium are added as compounds such as carbides, nitrides, oxides and hydrides.

Furthermore, the microdrill bit in accordance with the present invention may further comprise a hard coating vapordeposited on the surface of the aforesaid cemented carbide in order to further increase wear resistance. The hard coating may be comprised of at least one compound selected from the group consisting of titanium carbide (TiC), titanium carbo-nitride (TiCN) and titanium nitride (TiN), and in such a case, the thickness is set so as to range from 0.1 μm to 4.0 μm. If the thickness is less than 0.1 μm, the wear resistance is not sufficiently increased. On the other hand, if the thickness exceeds 4.0 μm, the drill bit becomes susceptible to fracturing. The hard coating could as well be formed of diamond so as to have a thickness of 0.1 μm to 4.0 μm. This range of thickness is determined by similar reasons in consideration of the wear resistance and susceptibility to fracturing.

The present invention will now be described in detail with reference to the following examples.

EXAMPLE 1

There were prepared powders of WC (average particle size: 0.6 μm), VC (1.0 μm), VN (1.2 μm), $V_2O_5$ (0.5 μm), $Cr_3C_2$ (1.5 μm), CrN (1.3 μm), $Cr_2O_3$ (0.5 μm), Co (1.2 μm), CrH (1.6 μm), and VH (1.7 μm). These powders were blended in various compositions as set forth in TABLE 1 and ground in acetone in a ball mill for 72 hours and dried.

Subsequently, a small amount of wax was added, and the mixed powders were subjected to extrusion molding under a pressure of 15 $Kg/mm^2$ by an extrusion press to produce cylindrical green compacts of a circular cross-section of 4.60 mm in diameter. These compacts were heated at 400° C. to 600° C. for 3 hours to remove the wax, and then sintered by holding them at a temperature of 1,350° C. to 1,450° C. in a vacuum for 1 hour to produce WC-based cemented carbides 1 to 15 of the invention.

For comparison purposes, the same powders were blended in different compositions as set forth in TABLE 3, and the same procedures as described above were repeated to prepare comparative cemented carbides 1 to 8.

Then, with respect to all of the cemented carbides 1 to 15 of the invention and the comparative cemented carbides 1 to 8, their compositions and the Rockwell A scale hardnesses were measured. The results are set forth in TABLES 2 and 4.

Subsequently, the cemented carbides 1 to 15 of the invention and the comparative cemented carbides 1 to 8 were machined into microdrill bits 1 to 15 of the invention and comparative microdrill bits 1 to 8, respectively. Each microdrill bit had an overall length of 38.1 mm, a shank diameter of 3.175 mm, a cutting portion diameter of 0.4 mm, and a cutting portion length of 6 mm. These microdrill bits 1 to 15 of the invention and the comparative microdrill bits 1 to 8 were subjected to a drilling test for making bores in printed-circuit boards under the following conditions:

Workpiece: two stacked four-layered boards of glass and epoxy
Rotational speed: 70,000 r.p.m.
Feed rate: 2,100 mm/min.
Number of drilling: 5,000 times In the test, the reduction in cutting portion diameter of each microdrill bit was measured.

Furthermore, the aforesaid microdrill bits were all subjected to another drilling test under the following conditions:

Workpiece: three stacked four-layered boards of glass and epoxy
Rotational speed: 70,000 r.p.m.
Feed rate: 3,000 mm/min
Number of drilling: 1,000 times In this test, it was determined how many drills out of twenty were subject to fracturing.

The results of the above tests are set forth in TABLES 2 and 4.

As will be seen from TABLES 1 to 4, the microdrill bits 1 to 15 of the invention exhibited excellent wear resistance and fracture resistance as compared with the comparative microdrill bits 1 to 8.

EXAMPLE 2

The microdrill bits 1 to 13 of the invention obtained in EXAMPLE 1 were utilized, and various coating layers as set forth in TABLE 5 were applied to the surfaces of the microdrill bits to produce surface coated microdrill bits 1 to 9 with preferred coating thicknesses and comparative surface coated microdrill bits 10 to 13 with coating thicknesses outside the preferred range. These microdrill bits were subjected to a drilling test under the same conditions as in EXAMPLE 1. The results are shown in Table 5.

As will be seen from TABLE 5, the surface coated microdrill bits 1 to 9 of the invention exhibited greater wear resistance and fracture resistance than the comparative surface coated microdrill bits 10 to 13.

TABLE 1

| Drill bits of the invention | Blend composition of powders (% by weight) | | | | | | | | | | Sintering Condition | |
|---|---|---|---|---|---|---|---|---|---|---|---|---|
| | WC | Co | $Cr_3C_2$ | CrN | $Cr_2O_3$ | CrH | VC | VN | $V_2O_5$ | VH | Temp. (°C.) | Time (Hr) |
| 1 | other | 6 | 0.3 | — | — | — | 0.3 | — | — | — | 1410 | 1 |
| 2 | other | 6 | 0.5 | — | — | — | — | 0.2 | — | — | 1410 | 1 |
| 3 | other | 6 | — | 0.5 | — | — | 0.2 | — | — | — | 1410 | 1 |
| 4 | other | 8 | 0.6 | — | — | — | 0.4 | — | — | — | 1390 | 1 |
| 5 | other | 8 | 0.7 | — | — | — | — | 0.2 | — | — | 1390 | 1 |
| 6 | other | 8 | — | 0.6 | — | — | 0.4 | — | — | — | 1390 | 1 |
| 7 | other | 9 | 0.7 | — | — | — | 0.4 | — | — | — | 1390 | 1 |
| 8 | other | 9 | — | 0.7 | — | — | — | 0.4 | — | — | 1390 | 1 |
| 9 | other | 10 | 0.8 | — | — | — | 0.4 | — | — | — | 1370 | 1 |
| 10 | other | 10 | — | 0.6 | — | — | 0.6 | — | — | — | 1370 | 1 |
| 11 | other | 10 | 0.9 | — | — | — | — | — | 0.3 | — | 1370 | 1 |
| 12 | other | 10 | 0.9 | — | — | — | — | — | — | 0.3 | 1370 | 1 |
| 13 | other | 12 | 1.3 | — | — | — | 0.5 | — | — | — | 1350 | 1 |
| 14 | other | 12 | — | — | 0.6 | — | 1.0 | — | — | — | 1350 | 1 |
| 15 | other | 12 | — | — | — | 0.9 | 0.5z | — | — | — | 1350 | 1 |

TABLE 2

| Drill bits of the invention | Composition of cemented carbide (% by weight) | | | | | | | | Hardness | Drilling tests | |
|---|---|---|---|---|---|---|---|---|---|---|---|
| | Binder phase composition (weight ratio) | | | | | | Binder phase | WC | $H_RA$ | Reduction in cutting portion diameter (μm) | Number of fractured drill bits/ Number of tested drill bits |
| | c/A | d/A | (c + d)/A | c/(c + d) | a/A | b/A | | | | | |
| 1 | 0.037 | 0.009 | 0.046 | 0.804 | 0.095 | other | 0.070 | other | 93.8 | 10 | 3/20 |
| 2 | 0.065 | 0.006 | 0.071 | 0.915 | 0.021 | other | 0.066 | other | 93.5 | 13 | 2/20 |
| 3 | 0.057 | 0.009 | 0.066 | 0.864 | 0.063 | other | 0.069 | other | 93.5 | 12 | 2/20 |
| 4 | 0.056 | 0.008 | 0.064 | 0.875 | 0.067 | other | 0.092 | other | 93.3 | 12 | 0/20 |
| 5 | 0.057 | 0.003 | 0.060 | 0.950 | 0.030 | other | 0.088 | other | 92.9 | 15 | 0/20 |
| 6 | 0.051 | 0.008 | 0.059 | 0.864 | 0.082 | other | 0.093 | other | 93.1 | 13 | 0/20 |
| 7 | 0.058 | 0.008 | 0.066 | 0.879 | 0.077 | other | 0.105 | other | 93.2 | 12 | 0/20 |
| 8 | 0.054 | 0.008 | 0.062 | 0.871 | 0.061 | other | 0.103 | other | 93.0 | 15 | 1/20 |
| 9 | 0.061 | 0.008 | 0.069 | 0.884 | 0.046 | other | 0.113 | other | 92.8 | 15 | 0/20 |
| 10 | 0.041 | 0.007 | 0.048 | 0.854 | 0.087 | other | 0.116 | other | 93.0 | 15 | 0/20 |
| 11 | 0.070 | 0.008 | 0.078 | 0.897 | 0.025 | other | 0.112 | other | 92.6 | 18 | 1/20 |
| 12 | 0.070 | 0.008 | 0.078 | 0.897 | 0.020 | other | 0.111 | other | 92.6 | 17 | 0/20 |
| 13 | 0.084 | 0.010 | 0.094 | 0.894 | 0.019 | other | 0.135 | other | 92.6 | 17 | 3/20 |

TABLE 2-continued

| Drill bits of the invention | Composition of cemented carbide (% by weight) | | | | | | | | Hardness | Drilling tests | |
|---|---|---|---|---|---|---|---|---|---|---|---|
| | Binder phase composition (weight ratio) | | | | | | Binder | | | Reduction in cutting portion diameter | Number of fractured drill bits/ Number of tested drill bits |
| | c/A | d/A | (c + d)/A | c/(c + d) | a/A | b/A | phase | WC | $H_RA$ | (μm) | |
| 14 | 0.022 | 0.019 | 0.041 | 0.537 | 0.005 | other | 0.126 | other | 93.1 | 15 | 3/20 |
| 15 | 0.031 | 0.009 | 0.040 | 0.775 | 0.050 | other | 0.132 | other | 92.4 | 20 | 2/20 |

a: W, b: Co, c: Cr, d: V
A = a + b + c + d

TABLE 3

| Comparative drill bits | Blend composition of powders (% by weight) | | | | | | | | | | Sintering condition | |
|---|---|---|---|---|---|---|---|---|---|---|---|---|
| | WC | Co | $Cr_3C_2$ | CrN | $Cr_2O_3$ | CrH | VC | VN | $V_2O_5$ | VH | Temp. (°C.) | Time (Hr) |
| 1 | other | 5 | — | 0.2 | — | — | 0.2 | — | — | — | 1410 | 1 |
| 2 | other | 13 | 0.2 | — | — | — | 0.6 | — | — | — | 1350 | 1 |
| 3 | other | 10 | 0.1 | — | — | — | 0.4 | — | — | — | 1370 | 1 |
| 4 | other | 8 | 1.8 | — | — | — | 0.4 | — | — | — | 1390 | 1 |
| 5 | other | 10 | 0.8 | — | — | — | 0.05 | — | — | — | 1370 | 1 |
| 6 | other | 8 | 0.6 | — | — | — | 1.8 | — | — | — | 1390 | 1 |
| 7 | other | 10 | 0 | — | — | — | 0.6 | — | — | — | 1370 | 1 |
| 8 | other | 12 | 0.6 | — | — | — | 0 | — | — | — | 1390 | 1 |

TABLE 4

| Comparative drill bits | Composition of cemented carbide (% by weight) | | | | | | | | Hardness | Drilling tests | |
|---|---|---|---|---|---|---|---|---|---|---|---|
| | Binder phase composition (weight ratio) | | | | | | Binder | | | Reduction in cutting portion diameter | Number of fractured drill bits/ Number of tested drill bits |
| | c/A | d/A | (c + d)/A | c/(c + d) | a/A | b/A | phase | WC | $H_RA$ | (μm) | |
| 1 | 0.020 | 0.009 | 0.029 | 0.690 | 0.051 | other | 0.055 | other | 94.2 | 18 | 20/20 |
| 2 | 0.012 | 0.013 | 0.025 | 0.480 | 0.150 | other | 0.146 | other | 91.5 | 65 | 15/20 |
| 3 | 0.008 | 0.009 | 0.017 | 0.471 | 0.102 | other | 0.114 | other | 91.9 | 48 | 11/20 |
| 4 | 0.115 | 0.003 | 0.118 | 0.975 | 0.066 | other | 0.098 | other | 93.3 | 33 | 20/20 |
| 5 | 0.052 | 0.001 | 0.053 | 0.981 | 0.107 | other | 0.119 | other | 91.8 | 58 | 12/20 |
| 6 | 0.026 | 0.027 | 0.053 | 0.491 | 0.017 | other | 0.084 | other | 93.5 | 42 | 20/20 |
| 7 | 0 | 0.009 | 0.009 | 0 | 0.080 | other | 0.110 | other | 92.6 | 40 | 10/20 |
| 8 | 0.047 | 0 | 0.047 | 1.000 | 0.090 | other | 0.139 | other | 91.5 | 60 | 15/20 |

a: W, b: Co, c: Cr, d: V
A = a + b + c + d

TABLE 5

| | | Microdrill bits of the invention of TABLE 1 | Hard coating layers | Average thickness of coating (μm) | Drilling tests | |
|---|---|---|---|---|---|---|
| | | | | | Reduction in cutting portion diameter (μm) | Number of fractured drill bits/ Number of tested drill bits |
| Surface coated drill bits of the invention | 1 | Drill bit 4 | TiC | 0.3 | 7 | 3/20 |
| | 2 | 4 | TiN | 1.2 | 7 | 3/20 |
| | 3 | 4 | TiCN | 0.6 | 6 | 2/20 |
| | 4 | 9 | TiC/TiN | 1.5 | 6 | 3/20 |
| | 5 | 10 | TiC/TiCN | 1.3 | 7 | 3/20 |
| | 6 | 10 | TiC/TiCN/TiN | 3.8 | 7 | 4/20 |
| | 7 | 2 | Artificial Diamond | 0.9 | 6 | 3/20 |
| | 8 | 7 | Artificial Diamond | 2.0 | 7 | 2/20 |
| | 9 | 7 | Artificial Diamond | 3.8 | 8 | 3/20 |
| Comparative surface coated drill bits | 10 | 4 | TiC | 4.5 | 10 | 18/20 |
| | 11 | 10 | TiC/TiN | 5.0 | 11 | 20/20 |
| | 12 | 5 | Artificial Diamond | 0.05 | 15 | 10/20 |
| | 13 | 10 | Artificial Diamond | 7.0 | 12 | 18/20 |

What is claimed is:

1. A microdrill bit made of a tungsten carbide based cemented carbide which contains a binder phase of 6% by weight to 14% by weight of a cobalt alloy and a hard dispersed phase of balance tungsten carbide, said cobalt alloy being comprised of cobalt, chromium, vanadium and tungsten, and having weight ratios so as to satisfy the relationships of $0.04 \leqq (c+d)/(a+b+c+d) \leqq 0.10$ and $0.50 \leqq c/(c+d)$ 0.95, where a, b, c and d denote weight ratios of tungsten, cobalt, chromium and vanadium, respectively; said cemented carbide having a Rockwell A scale hardness of 92.0 to 94.0.

2. A microdrill bit according to claim 1, further comprising a hard coating of a thickness of 0.1 μm to 4.0 μm formed thereon, said hard coating being comprised of at least one compound selected from the group consisting of titanium carbide, titanium carbo-nitride and titanium nitride.

3. A microdrill bit according to claim 1, further comprising a hard coating of diamond formed thereon and having a thickness of 0.1 μm to 4.0 μm.

* * * * *